US007450892B2

(12) United States Patent
Tsubota et al.

(10) Patent No.: US 7,450,892 B2
(45) Date of Patent: Nov. 11, 2008

(54) ELECTROPHOTOGRAPH DEVELOPING ROLLER AND IMAGE FORMING DEVICE USING THE SAME

(75) Inventors: Toshio Tsubota, Azumino (JP); Shinji Matsuzawa, Nagano (JP)

(73) Assignee: Fuji Electric Imaging Device Co., Ltd., Nagano-ken (JP)

( * ) Notice: Subject to any disclaimer, the term of this patent is extended or adjusted under 35 U.S.C. 154(b) by 443 days.

(21) Appl. No.: 10/567,062

(22) PCT Filed: Oct. 8, 2004

(86) PCT No.: PCT/JP2004/014970

§ 371 (c)(1),
(2), (4) Date: Apr. 5, 2006

(87) PCT Pub. No.: WO2005/036277

PCT Pub. Date: Apr. 21, 2005

(65) Prior Publication Data

US 2006/0204286 A1 Sep. 14, 2006

(30) Foreign Application Priority Data

Oct. 9, 2003 (JP) ..... 2003-350291

(51) Int. Cl.
*G03G 15/08* (2006.01)

(52) U.S. Cl. ..... 399/286; 399/279

(58) Field of Classification Search ..... 399/279, 399/286

See application file for complete search history.

(56) References Cited

U.S. PATENT DOCUMENTS 5,842,962 A * 12/1998 Yamada et al.
5,970,294 A * 10/1999 Narita et al. ..... 399/286
6,122,473 A * 9/2000 Goseki et al. ..... 399/286
6,438,841 B1 * 8/2002 Fuma et al.

FOREIGN PATENT DOCUMENTS

| | | |
|---|---|---|
| JP | 57-086869 | 5/1982 |
| JP | 60-143605 | 7/1985 |
| JP | 02-054287 | 2/1990 |
| JP | 07-261438 | 10/1995 |
| JP | 08-074839 | 3/1996 |

(Continued)

*Primary Examiner*—David M Gray
*Assistant Examiner*—Laura K Roth
(74) *Attorney, Agent, or Firm*—Manabu Kanesaka

(57) ABSTRACT

An electrophotographic developing roller in which air tightness and electrical conductivity in a fit section between a cylindrical metal base body and a metal flange are satisfactory and outside diameter deflection accuracy is satisfactory; and an electrophotographic developing roller which is relatively inexpensive, excellent in mechanical rigidity, surface processability and plating film formation (corrosion resistance) and capable of being satisfied with a prescribed dimensional accuracy are provided. The electrophotographic developing roller is a developing roller having a cylindrical metal base body and a metal flange. The metal flange has a larger diameter section to be fitted in the opening end inner surface of the cylindrical metal base body and a smaller diameter section serving as a central shaft body coaxial with the cylindrical metal base body. The fit section surface of the larger diameter section before being press fitted has an uneven shape such that a maximum surface roughness Ry due to a circumferential groove formed by cutting processing is from 25 μm to 70 μm.

24 Claims, 3 Drawing Sheets

FOREIGN PATENT DOCUMENTS

| | | |
|---|---|---|
| JP | 08-184977 | 7/1996 |
| JP | 11-216621 | 8/1999 |
| JP | 11-249416 | 9/1999 |
| JP | 2001-125370 | 5/2001 |
| JP | 2001-221227 | 8/2001 |
| JP | 2003-091198 | 3/2003 |
| JP | 2003-263019 | 9/2003 |
| JP | 2004-109525 | 4/2004 |

* cited by examiner

ELECTROPHOTOGRAPH DEVELOPING ROLLER AND IMAGE FORMING DEVICE USING THE SAME

TECHNICAL FIELD

The present invention relates to an electrophotographic developing roller which is used in image forming devices by an electrophotographic system such as printers, copiers, and facsimiles. In particular, the invention relates to an electrophotographic developing roller to be used in a non-magnetic one-component non-contact development system and to an image forming device using the same.

BACKGROUND ART

An image forming device by an electrophotographic system performs repeated image formation by successively executing respective steps of charging, exposure, development, transfer, and cleaning by a charger, an exposing unit, a developing unit, a transfer unit, a cleaning unit, and the like which are disposed in the vicinity on the outer peripheral surface of a photoreceptor for forming an electrostatic latent image, thereby outputting a printed image. Recently, there is also present a cleaning-less system for simultaneously carrying out a cleaning step in a developing step.

A development method of an electrophotographic system includes dry development using a powdered toner and liquid development using a developing solution having a toner dispersed in a liquid. Of these, the dry development includes a one-component development system using only a toner as a developer and a two-component development system using a toner and a carrier (magnetic particle). In addition, the one-component development system is classified into a magnetic one-component development system and a non-magnetic one-component development system depending upon the presence or absence of magnetism of the toner.

In the respective development systems, it is generally carried out by using a developing roller in a columnar form as a developer carrier which comes into contact with or becomes adjacent to a photoreceptor to feed a developer.

For example, since in order to carry a carrier or a magnetic toner, it is required to dispose a magnet roller internally, a cylindrical base body having a space therein is used as a developing roller to be used in the two-component development system or magnetic one-component development system. Furthermore, since a developing roller to be used in the non-magnetic one-component development system is not required to be cylindrical, in the contact system, there may be the case where a soft organic urethane rubber roller or the like is used, while in both the contact system and the non-contact system, a cylindrical base body having a space therein is used, also for the reason of weight reduction or the like.

In general, a metal is used as the quality of material for the cylindrical base body, and in the two-component development system or the magnetic one-component system, for the sake of not obstructing a magnetic force by the internally disposed magnet roller, an aluminum alloy which is anon-magnetic body is frequently used. Besides the aluminum alloy, for example, Patent Document 1 describes a magnet roller for magnetic brush development using a non-magnetic austenitic stainless steel tube. Furthermore, Patent Document 2 describes a developer carrier (developing roller) using an aluminum alloy and also suggests the use of an iron alloy. In addition, Patent Document 3 describes a support for developing roller containing from 1 to 3% by weight of manganese. Moreover, Patent Document 4 describes a developer carrier (developing roller) using an austenitic stainless steel welded tube (electro-resistance-welded tube).

In the non-magnetic one-component development system, an aluminum alloy having excellent processability is also frequently used. Besides the aluminum alloy, for example, Patent Document 5 describes that an iron based metal, STKM, a ferritic stainless steel alloy, or SUS430 is used as a developing roller to be used in the one-component contact development system. This is aimed to provide a uniform a butting pressure by using a magnetic body as a developing roller and using an elastic body magnet roller as a toner resisting roller.

Furthermore, the outer peripheral surface of a cylindrical metal base body is subjected to a variety of treatments or provided with a rubber or resin layer as the need arises. In addition, in an end section of a cylindrical metal base body, for the purpose of holding the base body and rotationally driving it, it is generally configured to provide a small diameter central shaft body coaxial with the cylindrical metal base body. As a method for providing such a central shaft body in the end section of the cylindrical base body, there is known a method for press fitting a metal flange having a central shaft body in the end section of the cylindrical base body.

As described previously, the non-magnetic one-component development system includes a non-magnetic one-component contact development system in which a photoreceptor and a developing roller come into contact with each other and a non-magnetic one-component non-contact development system in which a photoreceptor and a developing roller become adjacent to each other in a non-contact state. An electrophotographic developing roller to be used in such a non-magnetic one-component non-contact development system has a non-contact development function such that a toner to be fed from a toner container via feed rollers is formed into a prescribed thin layer on a developing roller, delivered in the vicinity of the surface of a photoreceptor drum and applied onto an electrostatic latent image on the surface of the foregoing photoreceptor drum having a gap with the developing roller by an alternating current bias voltage to be applied to the developing roller, thereby achieving development. In such a non-contact development system, since the surface of the developing roller can be made of a hard metal material, there is an advantage that the life is long as compared with soft organic urethane rubber rollers to be used in the case of contact development. Also, since the foregoing developing roller for non-magnetic one-component does not require a magnet within the developing roller, there is obtained an advantage that it is inexpensive as compared with developing rollers having a magnet roller for magnetic toner. However, with respect to the matters that the non-magnetic toner be formed into a uniform thin layer on the developing roller and that the toner be uniformly charged with a stably necessary and sufficient charge amount to obtain a surface state of the developing roller suitable for delivery in the vicinity of the surface of the photoreceptor drum, a degree of difficulty is high.

On the other hand, recently, in the electrophotographic device, response to full coloration is developing, too. Following this, in the full-color electrophotographic device, a non-magnetic developer of a one-component development system has become frequently used. The one-component development system is a system in which a developer is adhered with a frictional electrification amount of the developer without using a carrier and delivered, thereby achieving development. In the non-magnetic one-component development system, there are merits that the maintenance is easy because a carrier is not used; that it is possible to make the unit small in size because a magnet is not required within a developer carrier; and that it is inexpensive.

In the non-magnetic one-component non-contact development system, the developer is held on the surface of the developing roller due to an image force and delivered in the vicinity of the surface of the photoreceptor due to rotation of the developing roller, thereby achieving development. Since this image force depends upon a frictional electrification amount of the developer as generated due to friction of the developer with the surface and a layer thickness restricting member of the developing roller, surface roughness (formation of irregularities) of the developing roller is extremely important. For that reason, for the developing roller, ones resulting from coating a resin on a cylindrical metal base body and ones resulting from subjecting a cylindrical metal base body to a treatment such as mechanical processing and plating are used, and aluminum alloys are broadly used as the cylindrical metal base body. For example, Patent Document 4 describes a blast treated developer carrier; Patent Document 6 describes a developer supporting member (developing roller) resulting from a blast treatment and subsequently a hard plating treatment; and Patent Document 2 describes a developer carrier (developing roller) using an aluminum alloy or an iron alloy resulting from a blast treatment, an etching treatment or an electroless plating, respectively.

For a photoreceptor drum and a developing roller to be mounted in an electrophotographic device of a full-color non-magnetic one-component non-contact development system, in order to respond to registration accuracy of primary color images necessary for full coloration, it is required to make a gap between the photoreceptor drum and the developing roller highly uniform. In recent full-color electrophotographic devices, it is necessary to have an extremely high shape accuracy such that an outside diameter deflection characteristic in the photoreceptor drum and the developing roller is not more than 30 μm, and further not more than 20 μm in the state that a shaft is provided. This is because in the case where the outside diameter deflection is large at the time of rotational driving of the developing roller, since in delivering the developer from the developing roller to the photoreceptor drum, a surface distance between the developing roller and the photoreceptor drum becomes non-uniform, the delivery amount of the developer to the photoreceptor drum having a latent image thereon becomes non-uniform, thereby revealing image unevenness. For that reason, in particular, with respect to a developing roller to be used in an electrophotographic image forming device capable of obtaining a stable color image with high image quality, it has become necessary to more greatly enhance the dimensional accuracy.

As the developing roller to be used in the non-magnetic one-component non-contact development system, for example, there is one principally constructed of a combination of a cylindrical metal base body and a central shaft body as press fitted in both end sections for holding the base body and rotationally driving it. In the developing roller having such a construction, even if only the cylindrical metal base body is finished with a very high accuracy, there may be the case where after press fitting of the central shaft body, a deviation is generated in shaft fitting, etc., whereby the outside diameter deflection may possibly become large. Therefore, press fitting of the central shaft body is also extremely important in obtaining a high-accuracy developing roller. Furthermore, in many cases, after the foregoing shaft body has been press fitted in the both ends of the cylindrical metal base body, the outer surface of the developing roller is subjected to a surface treatment so as to have a required surface roughness by mechanical processing such as sand blast and shot blast, and after further washing, the resulting surface is subjected to a treatment such as nickel plating. On this occasion, when air tightness in the fit section of the central shaft body is poor, a washing liquid, a plating liquid, or the like may possibly invade into the developing roller. When the developing roller having such an invaded liquid therein is put into actual use as it is, since there is some possibility that the invaded liquid leaks out during the use, such a developing roller is an inferior product which should be avoided. Accordingly, the air tightness in the fit section is one of the important functions which are necessary and indispensable for the developing roll having such a construction.

In addition, in order to manufacture a developing roller which has high dimensional accuracy (deflection characteristic), acquisition of tube stock materials having high mechanical rigidity and capable of easily revealing shape accuracy (straightness and coaxiality), a processing method for enabling one to reduce a processing strain (return of residual stress), and the like are needed. Furthermore, in order to frictionally electrify the developer, determination of a roughing surface treatment condition for forming irregularities of the required surface roughness on the outer peripheral surface of the developing roller, determination of a hard plating treatment condition for ensuring friction resistance (maintenance of frictional electrification performance) and corrosion resistance, and the like are important, too.

Here, an invention for making a gap between an electrophotographic photoreceptor and a development sleeve with a shaft uniform in the axial direction by centerless grinding of the shaft and the sleeve cylindrical body at the same time, thereby suppressing the shaft deflection is well known (paragraph 0010 of Patent Document 7).

Furthermore, an invention in which a knurl is formed on the surface of a fit section between a shaft and a cylindrical body to make an interference (press fitting margin) small, whereby a bulge of a sleeve can be reduced and a gap between an electrophotographic photoreceptor and a development sleeve is made uniform is also known (paragraph 0011 of Patent Document 8). In addition, an invention for employing an interference fit relationship for coupling between a shaft and a development sleeve is also known (Patent Documents 9 and 10).

Patent Document 1: JP-B-3-1805
Patent Document 2: JP-A-2003-263019
Patent Document 3: JP-A-7-261438
Patent Document 4: JP-A-2-54287
Patent Document 5: JP-A-2004-109525
Patent Document 6: JP-B-3-35664
Patent Document 7: JP-A-8-74839
Patent Document 8: JP-A-2001-221227
Patent Document 9: JP-A-8-184977
Patent Document 10: JP-A-11-216621

DISCLOSURE OF THE INVENTION

Problems that the Invention is to Solve

The foregoing cylindrical metal base body made of an aluminum alloy is a molded stock tube resulting from extruding or drawing an aluminum alloy ingot and is required to be subjected to cutting processing for centering because the nonuniformity in wall thickness is large; and since the amount of cutting off is large, the wall thickness of the stock tube before processing must be made thick. In order to meet the foregoing dimensional accuracy, since the aluminum tube stock is poor in mechanical rigidity because it is a hard-to-cut material, a special processing method for reducing a processing strain (return of residual stress) due to cutting or polishing processing for revealing shape accuracy (straightness and coaxiality) is necessary, and in order to resist the processing strain, the wall thickness of the tube stock must be further thickened, resulting in increases in material costs and processing costs, whereby the price becomes high.

Furthermore, as described previously, as a method for forming irregularities on the surface of a cylindrical metal base body, a blast treatment or the like is employed. However, since an aluminum alloy is low in mechanical rigidity, in such a roughing treatment, the wall thickness must be made thick in order to resist a processing strain to be applied on the surface of the base body. In addition, in maintaining a frictional electrification performance with a developer, a material having high abrasion resistance is demanded because the aluminum alloy is relatively low in hardness.

Moreover, in the electroless formation of a nickel plating layer, an aluminum alloy is a material having a base oxidation-reduction potential, and nickel is hardly deposited directly thereon, resulting in a problem in adhesion. Thus, as a countermeasure thereto, prior to forming a plating layer, the aluminum alloy is subjected to a zincate treatment (zinc alloy film formation), thereby achieving displacement plating. Accordingly, since stable film formation is difficult, selection of a material which does not require a special pre-treatment is demanded.

On the other hand, in press fitting the foregoing metal flange into the cylindrical metal base body, when an adhesive is used in a fit section for the purpose of enhancing air tightness or fixing strength of the fit section, there is some possibility that electrical conductivity becomes worse. In a developing roller, since an alternating current voltage is applied to a toner on the surface of the developing roller via a central shaft body, satisfactory electrical conductivity is necessary between the central shaft body and the cylindrical metal base body. However, for the purpose of achieving firm fitting so as to ensure satisfactory electrical conductivity to achieve firm fitting, when an interference (press fitting margin) between the outside diameter of the metal flange and the inner surface of the cylindrical metal base body is increased, since a large force is required for press fitting, there is some possibility that deformation of the base body is caused. When the base body is deformed to influence the outside diameter of the base body, an image could be affected as described previously. Thus, it is impossible to thoughtlessly increase the interference. Accordingly, there is required a fitting method that has satisfactory air tightness and electrical conductivity in the fit section, and that enables one to ensure outside diameter deflection accuracy.

In view of the points as explained previously, the invention has been made and is aimed to provide an electrophotographic developing roller for non-magnetic one-component non-contact development, which has satisfactory air tightness and electrical conductivity in a fit section of a central shaft body to be press fitted in both end sections of a cylindrical metal base body, has satisfactory outside diameter deflection accuracy and is suitable for color image formation. Also, the invention is aimed to provide an electrophotographic developing roller which is relatively inexpensive as a material of a developing roller for a color image forming device or the like using a non-magnetic one-component toner, is excellent in mechanical rigidity, surface processability and plating film formation (corrosion resistance) and can be satisfied with prescribed dimensional accuracy.

Means for Solving the Problems

In order to solve the foregoing problems, an electrophotographic developing roller of the invention is a developing roller having a cylindrical metal base body and a metal flange as press fitted in an opening end section of the subject cylindrical metal base body, the developing roller being characterized in that the subject metal flange has a larger diameter section for fitting in the opening end inner surface of the subject cylindrical metal base body and a smaller diameter section serving as a central shaft body coaxial with the subject cylindrical metal base body; and that the fit section surface of the subject larger diameter section before being press fitted has an uneven shape such that a maximum roughness Ry due to a circumferential groove formed by cutting processing is from 25 μm to 70 μm.

Also, another electrophotographic developing roller of the invention is a developing roller having a cylindrical metal base body and a metal flange as press fitted in an opening end section of the subject cylindrical metal base body, the developing roller being characterized in that the subject metal flange has a larger diameter section for fitting in the opening end inner surface of the subject cylindrical metal base body and a smaller diameter section serving as a central shaft body coaxial with the subject cylindrical metal base body; and that the fit section surface of the opening end section inner surface of the foregoing cylindrical metal base body before being press fitted has an uneven shape such that a maximum roughness Ry due to a circumferential groove formed by cutting processing is from 25 μm to 70 μm.

In the invention, it is preferable that an adhesive is used in the foregoing fit section, and an anaerobic adhesive is suitably used as the foregoing adhesive. Also, it is preferable that a countersunk section is provided on the opening end section inner surface of the foregoing cylindrical metal base body. It is also preferable that the thickness of the foregoing cylindrical metal base body is from 0.75 mm to 2 mm and that the interference at the time of press fitting is from 10 μm to 60 μm. In addition, it is preferable that the foregoing cylindrical metal base body and metal flange are each made of steel or an aluminum based alloy as the principal material. It is especially preferable that the foregoing cylindrical metal base body is made of a carbon steel tube containing not more than 0.25% by weight of carbon, not more than 0.30% by weight of silicon and not more than 0.85% by weight of manganese, respectively or an STKM11A carbon steel tube (JIS G3445).

In addition, a still another electrophotographic developing roller of the invention is a developing roller having at least a cylindrical metal base body, which comes into contact with or becomes adjacent to a photoreceptor, thereby feeding a developer on the surface of the subject photoreceptor and developing an electrostatic latent image formed on the subject photoreceptor, the developing roller being characterized in that the foregoing cylindrical metal base body is made of a carbon steel tube containing not more than 0.25% by weight of carbon, not more than 0.30% by weight of silicon and not more than 0.85% by weight of manganese, respectively.

In addition, an even another electrophotographic developing roller of the invention is a developing roller having at least a cylindrical metal base body, which comes into contact with or becomes adjacent to a photoreceptor, thereby feeding a developer on the surface of the subject photoreceptor and developing an electrostatic latent image formed on the subject photoreceptor, the developing roller being characterized in that the foregoing cylindrical metal base body is made of an STKM11A carbon steel tube (JIS G3445).

It is also preferred to use an electro-resistance-welded tube as the foregoing cylindrical metal base body. Furthermore, it is also preferred to subject the foregoing cylindrical metal base body to cutting processing or polishing processing or to subject the outer surface of the foregoing cylindrical metal base body to a blast treatment or metal plating. The outer surface of the foregoing cylindrical metal base body having been subjected to a blast treatment can be further subjected to metal plating. Moreover, electroless nickel plating is suitable as the foregoing metal plating. The outer surface of the foregoing cylindrical metal base body having been subjected to metal plating may be further subjected to a chromate treatment. In addition, the foregoing metal plating can be achieved without performing a zinc alloy film formation treatment in advance. It is suitable that the foregoing cylindrical metal base body has a straightness of not more than 15 μm and a deflection accuracy of not more than 20 μm. The electrophotographic developing roller of the invention can be suitably used in an electrophotographic device of a non-magnetic one-component non-contact development system and in particular, can be more suitably used in a color electrophotographic device.

In addition, an image forming device of the invention is characterized by mounting the foregoing electrophotographic developing roller.

Advantage of the Invention

According to the invention, it is possible to provide an electrophotographic developing roller for non-magnetic one-component non-contact development which is satisfactory in air tightness and electrical conductivity in the fit section of the metal flange to be press fitted in both end sections of the cylindrical metal base body, satisfactory in outside diameter deflection accuracy and suitable for color image formation. Also, according to the invention, by improving a material of the cylindrical metal base body of the (developing roller, it is possible to provide a developing roller which is inexpensive and excellent in mechanical rigidity, surface processability and corrosion resistance and satisfactory in a prescribed dimensional accuracy and which is especially suitable as a developing roller which is used in a developing unit which is used in a color electrophotographic device of a non-magnetic one-component non-contact development system.

DESCRIPTION OF REFERENCE NUMERALS AND SIGNS

Figure 1A:
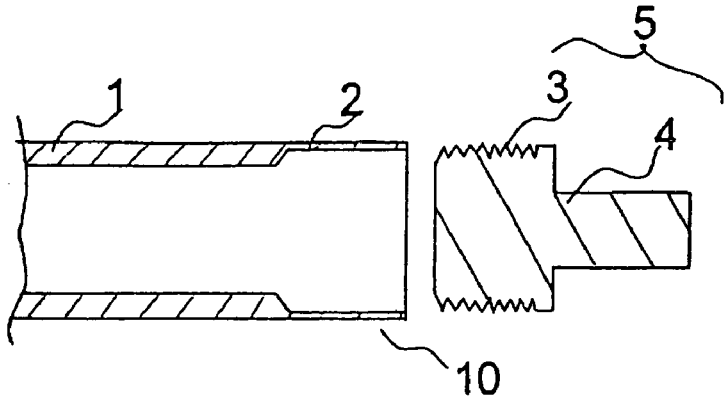
[FIG. 1](*a*) is a cross-sectional view to show the state before fitting a metal flange 5 into a cylindrical metal base body 1 according to a developing roller of the invention; and (*b*) is a front view of the metal flange of (*a*).

1: Cylindrical metal base body
2: Countersunk section
3: Larger diameter section
4: Smaller diameter section
5: Metal flange
6: Streak section (uneven shape)
7: Adhesive
10: Electrophotographic developing roller
41: Photoreceptor
42: Charger
43: Exposing unit
44: Developing unit
44-1: Developing roller
44-2: Toner layer restricting member
44-3: Toner feed roller
44-4: Toner agitating member
44-5: Toner storage section
45: Transfer unit
46: Paper to be transferred
47: Cleaning unit
51: Cylindrical metal base body
52: Central shaft body (metal flange)
53: Surface plate
54: Roller bearing tool
55: Dial gauge

BEST MODE FOR CARRYING OUT THE INVENTION

Best modes for carrying out the invention will be hereunder described with reference to the drawings.

Figure 1B:
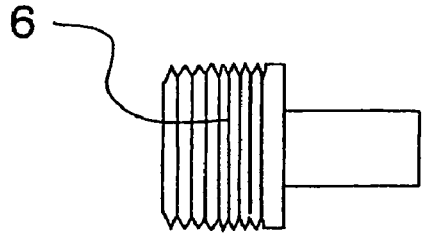
Figure 2A:
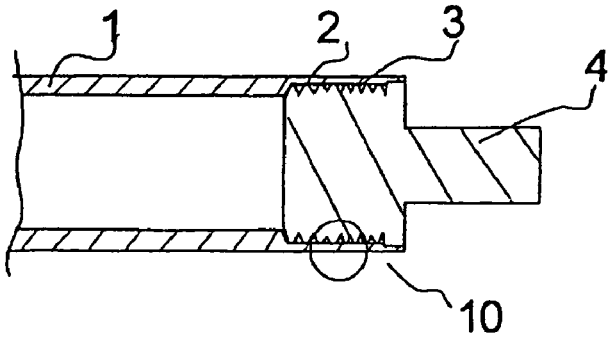
[FIG. 2](*a*) is a cross-sectional view to show an electrophotographic developing roller after press fitting a metal flange 5 into a cylindrical metal base body 1 according to a developing roller of the invention; and (*b*) is an enlarged view of a circle part of (*a*).
Figure 2B:
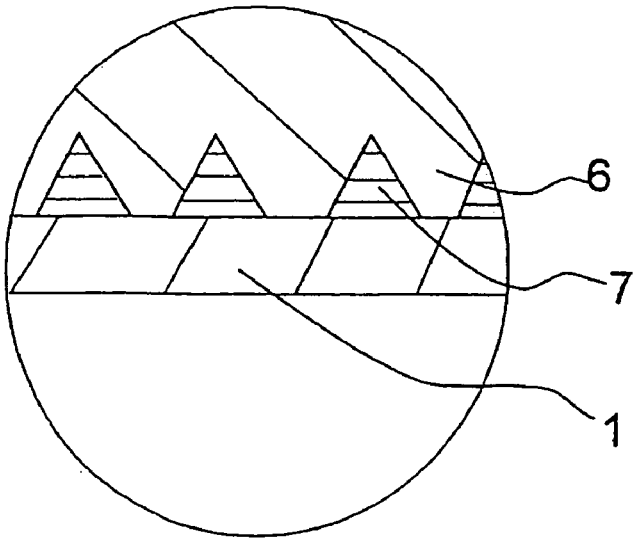
Figure 3A:
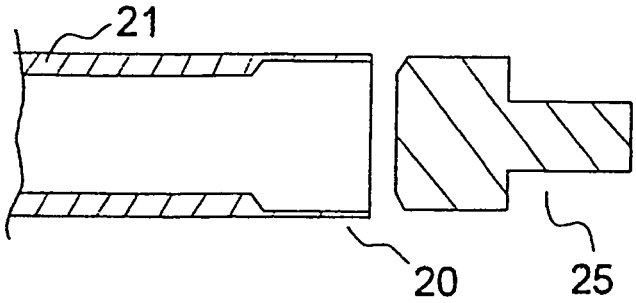
[FIG. 3](*a*) is a cross-sectional view to show the state before fitting a metal flange into a cylindrical metal base body according to the related art; and (*b*) is a front view of the metal flange of (*a*).
Figure 3B:
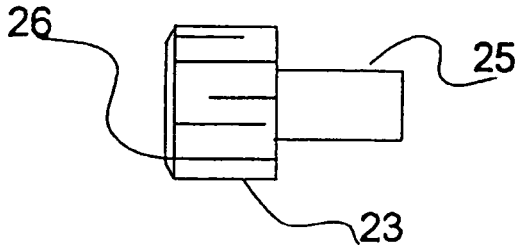

First of all, fitting of the cylindrical metal base body and the metal flange in the developer roller of the invention is explained with reference to FIGS. 1 to 3. FIG. 1(*a*) is a cross-sectional view of the principal selection of the developing roller according to the invention, which shows the state before making a smaller diameter section 4 of a metal flange 5 serve as a central shaft body coaxial with a cylindrical metal base body 1 by press fitting a larger diameter section 3 of the metal flange 5 into a countersunk section 2 provided on the opening end section inner surface of the foregoing cylindrical base body 1. FIG. 1(*b*) is a front view of the metal flange of FIG. 1(*a*). FIG. 2(*a*) is a cross-sectional view of the principal section to show the developing roller after press fitting the metal flange 5 into the cylindrical base body 1 from the state of FIG. 1. FIG. 2(*b*) is an enlarged view of a fit part marked with a circle in FIG. 2(*a*). FIG. 3(*a*) is a cross-sectional view of the principal section of a conventional developing roller, which shows the state before fitting of a metal flange and a cylindrical base body; and FIG. 3(*b*) is a front view to show a conventional metal flange which is provided with galling.

The developing roller according to the invention is mainly used in a non-contact development system with a non-magnetic one-component toner. With respect to the non-contact development, as explained in the foregoing Patent Documents 7 to 10, a gap is present between an electrophotographic photoreceptor and a developing roller. Since a toner is applied from the developing roller to an electrostatic latent image on the surface of the photoelectric photoreceptor via this gap under an alternating current bias voltage, thereby achieving development, whether or not a distance of this gap is uniform over the surface of the developing roller in the axial direction largely affects the image quality, especially the color image quality. In order to make the distance of this gap uniform, in the case of rotating both the electrophotographic photoreceptor and the developing roller in the state that a metal flange with a shaft is installed (that is, the actual rotational drive), it is required that an outside diameter deflection of the respective cylindrical bodies is small. The "outside diameter deflection" as referred to herein means a maximum deflection in the upper side of the cylindrical body when roller bearings as a basis are placed in the lower side of the both ends of the cylindrical body and the cylindrical body is made to go one rotation. The measurement is carried out by a dial gauge or the like as placed in the upper side of the cylindrical body.

In coupling the cylindrical metal base body 1 and the metal flange 5 of a developing roller 10 as shown in FIGS. 1 and 2, when the coupling accuracy of the metal flange 5 to the cylindrical metal base body 1 is poor, the metal flange 5 may possibly be coupled in the bent state (without coaxiality) in both ends of the cylindrical metal base body 1. In such a case, the rotation behavior of the developing roller 10 becomes irregular so that unevenness in density corresponding to the rotational period of the cylindrical metal base body 1 may possibly be generated on a formed image. Furthermore, as shown in FIG. 3(*a*), a cylindrical metal base body 21 and a metal flange 25 are non-uniformly press fitted due to a galling 26 as shown in FIG. 3(*b*), whereby the deflection of a developing roller 20 may possibly become worse. In addition, as a result of the foregoing galling 26, when a formed concave linear crack occurs in the penetrated state through a fit section 23, air tightness may possibly be lost therefrom. The "galling 26" as referred to herein means that in the fit section, a local part on either one of the metal surfaces (for example, a convex having a hardness higher than the surroundings) locally galls the opposing other metal surface during press fitting, thereby forming a linear concave, and when this linear concave penetrates through the fit section 23, the air tightness is lost. In the invention, since streaks by a lathe are formed in the fit section, it is estimated that there is an effect for stopping the galling on the way. In the case of stopping the galling on the way within the fit section, it is thought that joint use with an adhesive can sufficiently guarantee the air tightness. However, in the foregoing galling, in the state that a linear concave having penetrated through the fit section is present, it was noted that the effect for enhancing the air tightness by an adhesive is so limited that the air tightness cannot be sufficiently guaranteed.

The larger diameter section 3 of the metal flange 5 is fitted in the both end sections of the cylindrical metal base body 1, and the smaller diameter section 4 of the metal flange 5 is protruded outwardly from the both end sections of the cylindrical metal base body 1 and serves as a central shaft body.

The straightness of the cylindrical metal base body 1 is preferably not more than 15 μm. This is because in the mutual gap with a photoreceptor drum, it is required to keep a uniform gap in the axial direction for the purpose of obtaining a satisfactory image. A desired ultimate accuracy of the foregoing straightness of the cylindrical metal base body 1 is obtained by cutting or polishing the surface of the cylindrical metal base body. In the developing roller having a metal flange press fitted therein, for the purposes of imparting electrification to a toner and bringing a delivery function of toner, the cylindrical surface is subjected to a prescribed surface treatment such as sand blast and further to a nickel plating treatment. As the nickel plating, well-known electroless plating or the like can be employed.

EXAMPLES

Experimental Examples 1 to 8

As the cylindrical metal base body 1 shown in the foregoing FIG. 1(*a*), a carbon steel tube (STKM11A) having a length of 350 mm, an outside diameter of 18.00 mm and an inside diameter of 16.00 mm is used, and a countersunk section having an inside diameter of 16.12 mm is formed in the both end sections thereof. As the metal flange 5 in the same drawing, a round bar of a free cutting steel (SUM24) is processed by cutting or other means into a shape having an outside diameter of the larger diameter section 3 of 16.17 mm and an outside diameter of the smaller diameter section 4 of 10.00 mm. In that case, an interference between the inner surface of the foregoing countersunk section and the outside diameter of the foregoing fit section is about 50 μm (since there are precisely tolerable dimensional errors in both the outside diameter of the fit section and the inside diameter of the countersunk section, the term "about" is used). In addition, a streak section 6 having a maximum surface roughness Ry of from 25 to 45 μm and a pitch of from 100 to 300 μm is formed on the outside diameter (surface of the fit section) of the larger diameter section 3 of the metal flange 5 by lathe processing. Thereafter, an anaerobic adhesive (a trade name: LOCTITE 638, manufactured by Henkel Japan Ltd.) is coated as an adhesive 7 in the streak section 6 of the larger diameter section 3 of this metal flange 5, and the metal flange 5 is press fitted into the countersunk section 2 of the foregoing cylindrical metal base body 1. By using the foregoing adhesive 7 jointly with press fitting, not only failure in air tightness can be substantially completely avoided, but also by the matter that the adhesive 7 plugs the streak concave as shown in FIG. 2(*b*), the streak convex is not covered by the adhesive 7. Therefore, it was noted that there is no problem in electrical conductivity. After press fitting due to the joint use with the adhesive 7, when the developing roller 10 was taken apart to pieces and examined, it was noted that the adhesive 7 invaded in the concave of the streak section 6 and the partial galling concave, thereby enhancing the air tightness. Besides the foregoing LOCTITE 638, anaerobic adhesives for fitting or for preventing the looseness of a screw and cyano acrylate based instant adhesives can also be used as the adhesive 7. As has been explained above, the formation of the streak section 6 by cutting involves an advantage such that as an extension of the usual processing into the flange shape due to cutting, it is required only to add the formation of the streak section 6 on the surface of the larger diameter section 3 without necessity of incorporating a separate step different from cutting such as knurling processing. Furthermore, an aluminum alloy or the like may be used as a metal other than the iron based metal to be used in the foregoing developing roller 10. Although in the foregoing explanation, the countersunk section 2 is formed, while in order to enhance the coaxiality accuracy, the countersunk section 2 is preferably present, or it can be omitted.

In the case of providing an interference of about 50 μm using the foregoing respective iron based materials, with respect to the cylindrical metal base body and metal flange, in order to find a proper streaking condition for satisfying the object of the invention regarding the formation condition of a streak section to be formed on the surface of a fit section by a lathe, the following experiments were carried out.

Experimental Example 1

A developing roller was prepared under the same condition as in that described above, except that as the streaking condition, the maximum surface roughness Ry and the pitch distance were changed to 22 μm and 115 μm, respectively.

Experimental Example 2

A developing roller was prepared under the same condition as in that described above, except that as the streaking condition, the maximum surface roughness Ry and the pitch distance were changed to 25 μm and 148 μm, respectively.

Experimental Example 3

A developing roller was prepared under the same condition as in that described above, except that as the streaking condition, the maximum surface roughness Ry and the pitch distance were changed to 31 μm and 180 μm, respectively.

Experimental Example 4

A developing roller was prepared under the same condition as in that described above, except that as the streaking condition, the maximum surface roughness Ry and the pitch distance were changed to 42 μm and 216 μm, respectively.

Experimental Example 5

A developing roller was prepared under the same condition as in that described above, except that as the streaking condition, the maximum surface roughness Ry and the pitch distance were changed to 45 μm and 217 μm, respectively.

Experimental Example 6

A developing roller was prepared under the same condition as in that described above, except that as the streaking condition, the maximum surface roughness Ry and the pitch distance were changed to 70 μm and 250 μm, respectively.

Experimental Example 7

A developing roller was prepared under the same condition as in that described above, except that as the streaking condition, the maximum surface roughness Ry and the pitch distance were changed to 80 μm and 300 μm, respectively.

Experimental Example 8

A developing roller was prepared under the same condition as in that described above, except that as the streaking condition, the maximum surface roughness Ry and the pitch distance were changed to 80 μm and 350 μm, respectively.

(Conventional Developing Roller)

With respect to the surface roughness of a conventional flange fit section, the maximum surface roughness Ry and the pitch were 5.5 μm and 37 μm, respectively, and the flange was press fitted into a cylindrical base body in the state of this usual cut surface as it was, thereby preparing a developing roller.

With respect to the developing rollers of the foregoing Experimental Examples 1 to 8 and the conventional developing roller, the deformation of an outside diameter, the electrical conductivity between the cylindrical base body and the flange, the air tightness, and the mechanical strength were measured, respectively. The measurement of the surface roughness was carried out according to JIS B0601-1994 at a cutoff of 0.8 mm, a measurement distance of 4 mm and a scanning speed of 0.5 mm/sec. The results obtained are shown in the following Table 1.

TABLE 1

| | Maximum surface roughness Ry (μm) | Pitch distance (μm) | Deformation of outside diameter (μm) | Electrical conductivity | Air tightness | Mechanical strength |
|---|---|---|---|---|---|---|
| Conventional Example | 5.5 | 37 | 10 | Δ | x | ○ |
| Experimental Example 1 | 22 | 115 | 5 | ○ | x | ○ |
| Experimental Example 2 | 25 | 148 | 3.5 | ○ | ○ | ○ |
| Experimental Example 3 | 31 | 180 | 3.5 | ○ | ○ | ○ |
| Experimental Example 4 | 42 | 216 | 3.5 | ○ | ○ | ○ |
| Experimental Example 5 | 45 | 217 | 3 | ○ | ○ | ○ |
| Experimental Example 6 | 70 | 250 | 3 | ○ | ○ | ○ |
| Experimental Example 7 | 80 | 300 | 3 | ○ | Δ | x |
| Experimental Example 8 | 80 | 350 | 3 | ○ | x | x |

As is clear from Table 1, since in the conventional developing roller, the surface roughness of the fit section surface is too low, an influence against the cylindrical metal base body due to the interference of about 50 μm in fitting is very large so that a large force is necessary for press fitting. For that reason, a deformation (10 μm) such as a bulge is generated on the outer surface of the cylindrical metal base body. Also, it is noted that galling is generated so that a problem occurs in the air tightness. In addition, when an adhesive was coated, a problem also occurred in the electrical conductivity.

On the other hand, in the case where the maximum surface roughness Ry is 22 μm as in Experimental Example 1, the air tightness was not satisfactory. Then, as a result of examination, it was noted that failure in air tightness occurred due to galling. In the case where the maximum surface roughness is from 25 μm to 70 μm as in Experimental Examples 2 to 6, not only was galling not generated so that no problem occurred in the air tightness, but also no problem occurred in any of the deformation of the outer surface of the cylindrical base body, the electrical conductivity and the mechanical strength. In the case of Experimental Examples 7 and 8, a problem which is thought to have been caused due to the fact that the maximum surface roughness Ry is as large as 80 μm occurred in the air tightness. Also, it is noted that a problem in the mechanical strength starts to occur.

In the foregoing experiments, though the streak section was formed on the surface of the larger diameter section to be faced at the fit section of the metal flange, the streak section may be formed on the opening end section inner surface to be faced at the fit section of the cylindrical metal base body or in the counter sunk section to be provided therein. Also, with respect to the thickness of the cylindrical metal base body, it was confirmed that the same effect is obtained not only in the case of 1 mm as in the foregoing experiments but also in the case in the range of from 0.75 to 2 mm. In addition, with respect to the interference, though the effect of the invention was explained in the case of about 50 μm in the foregoing Experimental Examples, it was confirmed that the effect of the invention is found in the case in the range of from 10 to 60 μm.

Next, the material of the cylindrical metal base body of the developing rollers of the invention is explained with reference to FIGS. 4 and 5.

Figure 4:
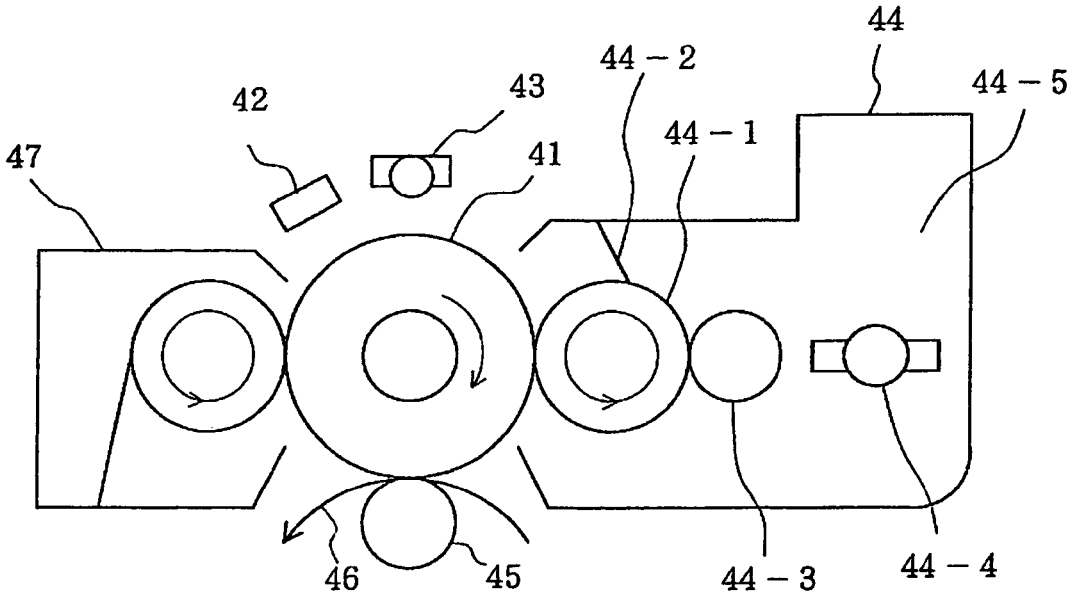
[FIG. 4] is a schematic cross-sectional view to show an electrophotographic image forming device containing a developing unit according to the invention.

FIG. 4 shows a schematic cross-sectional view of the principal section of an electrophotographic image forming device containing a developing unit. According to the illustrated image forming device, by respective electrophotographic process units to be disposed in the vicinity on the outer peripheral surface of a photoreceptor 41, such as a charger 42, an exposing unit 43, a developing unit 44, a transfer unit 45, and a cleaning unit 47, a fixing device (not shown in the drawing) of a paper 46 to be transferred, which is separately disposed, and the like, the foregoing respective processes are successively executed to form repeated images, thereby outputting a printed image. The developing unit 44 for image formation is constructed of a toner storage section 44-5, a toner agitating member 44-4, a toner feed roller 44-3 for delivering a toner onto a developing roller 44-1, a layer thickness restricting member 44-2 for forming a thin layer of a toner, and the developing roller 44-1.

Figure 5:
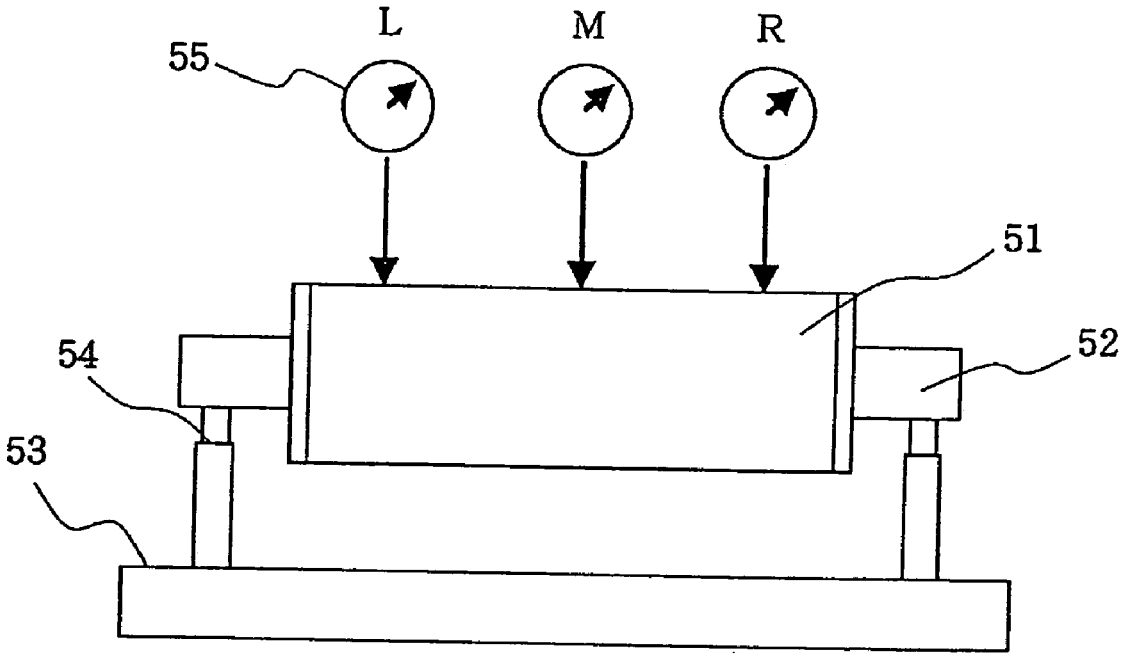
[FIG. 5] is an outline explanatory view to show a measurement method of a dimensional accuracy (deflection characteristic) of a developing roller according to the invention.

Furthermore, FIG. 5 shows a measurement method of a dimensional accuracy (deflection characteristic) of the developing roller of the invention. The illustrated developing roller has a structure in which a metal flange (corresponding to the symbol 5 in FIG. 1 but not shown in the drawing) having a central shaft body 52 (corresponding to the symbol 4 in FIG. 1) is press fitted into the both ends of a cylindrical metal base body 51 (corresponding to the symbol 1 in FIG. 1), and the central shaft body 52 is fixed to the main part of a developing unit (corresponding to the symbol 44 in FIG. 4 but not shown in the drawing) via a bearing and rotated.

The dimensional accuracy of the developing roller (corresponding to the symbol 10 in FIG. 2 and the symbol 44-1 in FIG. 4) is required as a deflection characteristic based on the size of the maximum deflection in the upper side of the cylindrical metal base body at the time of making the developing roller go one rotation on the basis of the outside diameter of the central shaft body in the state that the metal flange is press fitted into the both ends of the cylindrical metal base body. Concretely, a roller bearing tool 54 is disposed on a surface plate 53, the outside diameter of the central shaft body 52 is set on the roller bearing tool 54, and the maximum deflection of a dial gauge 55 is measured with respect to three points (measurement points L, M and R) in the cylindrical metal base body 51 in the axial direction while making the developing roller go one rotation.

(Selection of Material of Cylindrical Metal Base Body and Confirmation of Dimensional Accuracy)

As a cylindrical metal base body of a developing roller which is used in an electrophotographic image forming device using a non-magnetic one-component developer, the inventors paid attention to a carbon steel tube for machine structural purpose of a magnetic metal which is relatively inexpensive and high in mechanical rigidity because there is no delivery means by a magnetic force. The carbon steel tube for machine structural purpose is a steel product comprising iron having added thereto carbon, silicon, manganese, and so on and is enhanced with respect to the mechanical rigidity (tensile strength, elongation, etc.) while keeping processability. For the abrasion resistance of irregularities to be formed on the surface of the cylindrical metal base body, the carbon steel tube for machine structural purpose has a relatively high hardness and is effective. Also, in the electroless nickel plating formation, the carbon steel tube is a material which does not require a special pre-treatment with a catalytically active metal.

The following Table 2 shows the principal chemical components and mechanical nature with respect to carbon steel tubes for machine structural purpose as stipulated in JIS G3445 and an aluminum alloy JIS 6063 as stipulated in JIS H4080.

TABLE 2

| Carbon steel | Chemical components (% by weight) | | | Mechanical nature | | |
|---|---|---|---|---|---|---|
| | | | | Tensile strength | Elongation in MD direction | Flatness H |
| tube | Carbon, C | Silicon, Si | Manganese, Mn | ($N/mm^2$) | (%) | (D: diameter) |
| STKM11A | Not more than 0.12 | Not more than 0.35 | Not more than 0.60 | 290 or more | 35 or more | 1/2D |
| STKM12A | Not more than 0.20 | Not more than 0.35 | Not more than 0.60 | 340 or more | 35 or more | 2/3D |
| STKM13A | Not more than 0.25 | Not more than 0.35 | 0.30 to 0.90 | 370 or more | 30 or more | 2/3D |
| STKM14A | Not more than 0.30 | Not more than 0.35 | 0.30 to 1.00 | 410 or more | 25 or more | 3/4D |
| STKM15A | 0.25 to 0.35 | Not more than 0.35 | 0.30 to 1.00 | 470 or more | 22 or more | 3/4D |
| STKM16A | 0.35 to 0.45 | Not more than 0.40 | 0.40 to 1.00 | 510 or more | 20 or more | 7/8D |
| STKM17A | 0.45 to 0.55 | Not more than 0.40 | 0.40 to 1.00 | 550 or more | 20 or more | 7/8D |
| STKM18A | Not more than 0.18 | Not more than 0.55 | Not more than 1.50 | 440 or more | 25 or more | 7/8D |
| STKM19A | Not more than 0.25 | Not more than 0.55 | Not more than 1.50 | 490 or more | 23 or more | 7/8D |

TABLE 2-continued

| Carbon steel | Chemical components (% by weight) | | | Mechanical nature | | |
|---|---|---|---|---|---|---|
| | | | | Tensile strength | Elongation in MD direction | Flatness H |
| tube | Carbon, C | Silicon, Si | Manganese, Mn | ($N/mm^2$) | (%) | (D: diameter) |
| STKM20A | Not more than 0.25 | Not more than 0.55 | Not more than 1.60 | 540 or more | 23 or more | 7/8D |
| Aluminum alloy * JIS 6063 | — | 0.02 to 0.6 | Not more than 0.10 | 120 or more | 12 or more | |

* In the chemical components of the aluminum alloy, iron, copper, magnesium, chromium, zinc, and so on are contained in addition to those described in the table.

As shown in the foregoing Table 2, the carbon steel tube is classified into 10 kinds within the range of the chemical components wherein carbon (C) is not more than 0.55% by weight, silicon (Si) is not more than 0.55% by weight, and manganese (Mn) is not more than 1.6% by weight.

First of all, STMK16A having a relatively high mechanical rigidity among the carbon steel tubes as shown in the foregoing Table 2 was selected as the material of the cylindrical metal base body, and an electro-resistance-welded tube was obtained therefrom. For the purpose of revealing a shape accuracy (straightness) in this electro-resistance-welded tube, polishing processing was carried out, thereby preparing a developing roller. With respect to the conventional aluminum alloy-made cylindrical metal base body and the carbon steel-made cylindrical metal base body, whether or not the foregoing dimensional accuracy was obtained was compared and confirmed. As a result, it was confirmed that in the case where the cylindrical metal base body is made of an aluminum alloy, a tube stock having a wall thickness of from about 4.0 to 5.0 mm is necessary because the mechanical rigidity is low, while in the case where the cylindrical metal base body is made of a carbon steel tube, the shape accuracy can be achieved by a thin-walled tube stock having a wall thickness of from about 1.0 to 2.5 mm because the mechanical rigidity is high.

(Formation of Surface Irregularities)

The roughing treatment for forming irregularities on the surface of the developing roller is an important manufacture step for ensuring the frictional electrification amount of a non-magnetic one-component developer. As the roughing treatment method, a blast treatment is employed. Though the blast treatment includes a dry type and a wet type, a sand blast treatment using an abrasive grain, which is the dry type blast treatment, was employed herein. Then, a required surface roughness (Rz) was determined while confirming the correlation between the formation of irregularities and the frictional electrification performance (image quality) in an actual machine through various combinations of an abrasive grain and the roughing treatment condition. The manufacture factor of the sand blast treatment includes not only selection of an abrasive grain adaptive with the raw material of the carbon steel tube but also a nozzle size and an injection pressure for injecting the abrasive grain, a nozzle-work distance, the number of work revolution, a processing time, and the like, and these conditions were set up. In selecting the abrasive grain, though alumina or glass bead or the like is employed in an aluminum alloy, required irregularities could not be formed according to the conventional abrasive grain. In the carbon steel tube, since its hardness is relatively high, an abrasive grain having a higher hardness is required. From the stand point of forming a required irregular shape necessary for frictionally electrifying a toner, a blend of an abrasive grain having a high hardness and an abrasive grain having a low hardness was the most adaptive. In addition, it was confirmed that due to release of an internal stress by a pressure of the abrasive grain to be injected onto the surface, a lowering in the dimensional accuracy after processing occurs in a thin-walled tube stock of an aluminum alloy, while there is no problem in the change before and after the roughing treatment in a thin-walled tube stock of a carbon steel tube.

(Formation of Hard Plating Layer)

For abrasion resistance (maintenance of frictional electrification performance) and corrosion resistance of the irregularities formed on the surface of the cylindrical metal base body of the developing roller, the hard plating treatment condition was set up. Though the formation of an electroless Ni-P plating layer was employed as the hard plating, other hard plating such as electroless Ni-B plating and electroless Cr plating can be applied. The electroless plating is a method for reducing a metal ion from a metal salt-containing aqueous solution and depositing it on the surface of a base material, thereby forming a film and is roughly classified into autocatalytic plating for using a reducing agent depending upon a base material to be subjected to film formation and displacement plating utilizing a displacement reaction between a metal ion in a solution and a metal of the base material. An aluminum alloy is a material having a base oxidation-reduction potential, and nickel is hardly deposited directly thereon, resulting in a problem in adhesion. Thus, as a countermeasure thereto, prior to forming a plating layer, the aluminum alloy is subjected to a zincate treatment (zinc alloy film formation), thereby achieving the foregoing displacement plating. Furthermore, among iron alloys, with respect to metals with high corrosion resistance to which chromium or nickel is added, a firm passive state film is formed on the surface, and even when activated, a passive state film is immediately formed. Therefore, it is necessary that after activation, nickel strike plating due to electrodeposition is immediately applied and electroless nickel plating is then performed. Accordingly, the process management becomes complicated, and stable film formation is difficult. Thus, selection of a material which does not require a special pre-treatment was performed. The carbon steel tube is a material which does not require a special pre-treatment with a catalytically active metal and is relatively easily plated.

With respect to the film formation condition of electroless Ni-P plating, the determination of the phosphorus concentration in a plating liquid and additives other than a reducing agent, such as a buffer, a complexing agent, and a stabilizer, and the management of the pH and temperature of a plating bath liquid for determining the film quality and film forming rate are important. With respect to the phosphorus concentration of the plating liquid, when the phosphorus content is 8 to 10% by weight or more, the resulting film becomes an amorphous film and has a minute film quality with low internal stress, whereby the hardness increases and the mechanical nature and abrasion resistance are enhanced. Furthermore, though it is said that the electroless nickel plating is of a plating film with high corrosion resistance, the corrosion resistance is largely changed depending upon the composition of a base material, the surface state, the smoothness, the plating bath composition, the film thickness, and the like. With respect to the composition of a base material, a relatively stable plating layer was realized by using a carbon steel tube. In a developing roller having a plating layer formed thereon, a smudge (stain) is likely adhered on the surface, and the surface of a plating film which has been allowed to stand over a long period of time may possibly be oxidized to cause discoloration. Moreover, there is a problem that such a smudge or discoloration affects the image quality. In addition, with respect to the surface state and the film thickness, in order to faithfully reproduce irregularities formed by the roughing treatment by blast, when the plating film thickness is made thin, rust may possibly be generated. As a counter measure for rust prevention, after the formation of an electroless Ni-P plating layer, a chromate treatment for dipping in a mixed acid containing as the major component chromic acid is carried out. The chromate treatment has effects for enhancing the corrosion resistance and preventing the generation of rust, whereby the developing roller is made hardly stained.

(Confirmation of Mass Productivity)

In the foregoing (Selection of material of cylindrical metal base body and confirmation of dimensional accuracy), STKM16A as a carbon steel tube was selected, and it was confirmed that a required dimensional accuracy was obtained. Subsequently, in confirming mass productivity in (Formation of surface irregularities) and (Formation of hard plating layer) and so on, it was noted that scatter of the surface roughness (ten-point average roughness Rz) became large so that the surface roughness was not stable due to the sand blast treatment. In addition, an electroless Ni-P plating layer was formed on the surface of the base body to realize an image. As a result, an image obstacle of black spot appeared on a white paper copy. The surface of the developing roller corresponding to this image obstacle area was microscopically observed. As a result, a fine scratch was found, and the toner was confirmed to be fixed. In STKM16A, due to the fact that the amounts of addition of carbon, silicon and manganese as the chemical components are relatively high, though the mechanical rigidity is enhanced to satisfy the dimensional accuracy, it is thought that the material quality is too hard, thereby lowering the surface processability in the sand blast treatment. Thus, again, it has become necessary to select a material with optimum amounts of addition of the chemical components.

Experimental Example 9

Using a carbon steel tube for machine structural purpose, STKM16A (manufactured by Izumikokan Co., Ltd.) made of an electro-resistance-welded tube having an outside diameter ϕ18 mm, a length of 350 mm and an inside diameter ϕ16.00 mm, a countersunk section (ϕ16.12 mm, length: 10 mm) was formed on both end parts, thereby preparing a cylindrical metal base body.

Using a round bar of a free cutting steel (SUM24) as a metal flange, a metal flange (metal flange A) formed by subjecting the larger diameter section (outside diameter: ϕ16.17 mm, length: 8 mm) and the smaller diameter section (outside diameter: ϕ10.00 mm, length: 25 mm) to cutting processing, respectively and a metal flange (metal flange B) formed by the same processing as in the metal flange A, except for changing the length of the smaller diameter section to 42 mm were prepared.

Next, unevenness composed of a circumferential groove formed by cutting processing were formed under the same streak condition as in Experimental Example 4 on the outer surface of the larger diameter section of each of the foregoing metal flange A and metal flange B, an anaerobic adhesive (a trade name: LOCTITE 638, manufactured by Henkel Japan Ltd.) was coated on this uneven part, and then, the both metal flanges were press fitted into the cylindrical metal base body such that the larger diameter sections of the both metal flanged were fitted in the countersunk sections in the both ends of each of the foregoing cylindrical metal base bodies.

Next, the outer peripheral surface of each of the cylindrical metal base bodies was subjected to a sand blast treatment such that an average value of the surface roughness (Rz) was 7 μm, thereby forming irregularities. After washing, an electroless Ni-P plating layer was formed in a thickness of 3.0 μm, followed by subjecting to a chromate treatment, thereby preparing a developing roller.

Experimental Example 10

A developing roller was prepared in the same manner as in Experimental Example 9, except that a seamless tube made of an aluminum alloy JIS 6063 material having an outside diameter ϕ18 mm, a length of 350 mm and an inside diameter ϕ16.00 mm was used as the cylindrical metal base body; that a zinc alloy film forming treatment was performed prior to the formation of an electroless Ni-P plating layer; and that the chromate treatment was not performed.

(Evaluation)

The developing rollers of the respective Experimental Examples were evaluated with respect to the following items.

(1) Evaluation of Dimensional Accuracy (Deflection Characteristic):

For the purpose of confirming whether or not a prescribed dimensional accuracy was satisfied by enhancing the mechanical rigidity (tensile strength and elongation) depending upon the amount of addition of the major chemical components as shown in the foregoing Table 2, the dimensional accuracy of the developing roller of each of the Experimental Examples was measured as shown in FIG. 5. Concretely, as described previously, when the developing roller was made to go one rotation on the basis of the outside diameter of the central shaft body (set on the roller bearing tool) in the state of press fitting the metal flange into the cylindrical metal base body, the deflection was measured with respect to three points (measurement points L, M and R) by the dial gauge placed in the upper side of the cylindrical metal base body, and an average value in the three points was designated as an individual measurement value. The results are shown in terms of (minimum value) to (maximum value) of n=20 with respect to each of the Experimental Examples.

(2) Evaluation of Surface Processability:

For the purpose of confirming the surface processability in the sand blast treatment for forming irregularities, the surface roughness of the cylindrical metal base body after the sand blast treatment in each of the Experimental Examples was measured in terms of a ten-point average roughness (Rz) according to JIS B0601-1994. With respect to the respective Experimental Examples, scatter of Rz of n=20 was shown in terms of a difference between the maximum value and the minimum value. The measurement of the ten-point average roughness (Rz) was carried out at a cutoff of 0.8 mm, a measurement distance of 4 mm and a scanning speed of 0.5 mm/sec.

(3) Evaluation of Corrosion Resistance:

The developing roller of each of the Experimental Examples was allowed to stand in a saturated vapor in 5% NaCl air by salt water spraying at 35° C. for 24 hours, and the presence or absence of the generation of rust was confirmed in n=20 of each of the Experimental Examples.

STKM11A (Experimental Example 11), STKM13A (Experimental Example 12), STKM14A (Experimental Example 13), and STKM19A (Experimental Example 14) (all of which are manufactured by Izumikokan Co., Ltd.) was used as the cylindrical metal base body.

With respect to the developing rollers of Experimental Example 9 and Experimental Examples 11 to 14, the results of the respective evaluations of the dimensional accuracy (deflection characteristic), the surface processability, the corrosion resistance, and the image evaluation are shown in the following Table 4.

TABLE 4

| | Cylindrical metal base body (Carbon steel tube) | (1) Deflection characteristic [μm] | (2) Scatter of surface roughness (Rz) [μm] | (3) Corrosion resistance | (4) Image properties |
|---|---|---|---|---|---|
| Experimental Example 9 | STKM16A | 11 to 16 | 1.8 | Rust was confirmed in 4/20. | Black spot and unevenness in density |
| Experimental Example 11 | STKM11A | 12 to 18 | 1.0 | Rust was not generated. | Satisfactory |
| Experimental Example 12 | STKM13A | 12 to 18 | 0.9 | Rust was not generated. | Satisfactory |
| Experimental Example 13 | STKM14A | 12 to 17 | 0.8 | Rust was not generated. | Satisfactory |
| Experimental Example 14 | STKM19A | 11 to 18 | 1.3 | Rust was not generated. | Unevenness in density |

(4) Image Evaluation:

After evaluating the corrosion resistance, the developing roller of each of the Experimental Examples was incorporated into a color electrophotographic device of a non-magnetic one-component non-contact development system, and images with various patterns were printed in plain paper, thereby confirming a printed image quality. Also, the surface of the developing roller corresponding to an area where a printed image obstacle was generated was microscopically observed.

The results of comparing and evaluating the dimensional accuracy before and after the sand blast treatment in the developing rollers of Experimental Examples 9 and 10 are shown in the following Table 3.

TABLE 3

| | Cylindrical metal base body | (1) Deflection characteristic [μm] Before sand blast treatment | After sand blast treatment |
|---|---|---|---|
| Experimental Example 9 | Carbon steel tube (STKM16A) | 10 to 15 | 11 to 16 |
| Experimental Example 10 | Aluminum alloy (JIS 6063) | 22 to 29 | 27 to 35 |

It is noted from the evaluation results that the carbon steel tube is more satisfactory in the dimensional accuracy and less in the change after the roughing treatment than the aluminum alloy.

Experimental Examples 11 to 14

Developing rollers were prepared in the same manner as in Experimental Example 9, except that each of carbon steel tubes for machine structural purpose made of an electro-resistance-welded tube having an outside diameter ϕ18 mm, a length of 350 mm and an inside diameter ϕ16.00 mm:

According to the evaluation results, there was no meaningful difference in the dimensional accuracy (deflection characteristic) with respect to all of Experimental Example 9 and Experimental Examples 11 to 14. Also, in Experimental Examples 9 and 14, scatter of the surface roughness Rz by the roughing treatment for forming irregularities became large, and black spot and unevenness in density as image obstacles were confirmed. In addition, in Experimental Example 9, the generation of a scratch on the surface of the developing roller corresponding to an area where an image obstacle was generated was microscopically observed, and rust which appeared to be caused by the corrosion resistance evaluation test was confirmed. Accordingly, the developing rollers of Experimental Examples 11 to 13 are satisfactory in all of the dimensional accuracy, the surface processability and the corrosion resistance and free from an image obstacle and therefore, are suitable.

Analytical values of the chemical components by a fluorescent X-ray analysis of the carbon steel tubes as used in Experimental Example 9 and Experimental Examples 11 to 14 are shown in the following Table 5.

TABLE 5

| | Chemical components (wt %) Carbon, C | Silicon, Si | Manganese, Mn | Phosphorus, P | Sulfur, S |
|---|---|---|---|---|---|
| Experimental Example 9 (STKM16A) | 0.42 | 0.35 | 0.88 | 0.019 | 0.006 |
| Experimental Example 11 (STKM11A) | 0.06 | 0.15 | 0.34 | 0.019 | 0.004 |
| Experimental Example 12 (STKM13A) | 0.15 | 0.23 | 0.56 | 0.018 | 0.005 |

TABLE 5-continued

| | Chemical components (wt %) | | | | |
|---|---|---|---|---|---|
| | Carbon, C | Silicon, Si | Manganese, Mn | Phosphorus, P | Sulfur, S |
| Experimental Example 13 (STKM14A) | 0.25 | 0.30 | 0.85 | 0.020 | 0.004 |
| Experimental Example 14 (STKM19A) | 0.20 | 0.44 | 1.30 | 0.017 | 0.005 |

The following are noted from the foregoing results.

1) Experimental Example 9 and Experimental Examples 11 to 14 are substantially equal to each other in the dimensional accuracy (deflection accuracy). It is thought from this result that within the ranges of the chemical components as presently experimented with, the carbon steel tube has a sufficient mechanical rigidity as a cylindrical metal base body of a developing roller regardless of the amounts of the chemical components to be added. Thus, the carbon steel tube is suitable as a cylindrical metal base body of a developing roller.

2) In Experimental Example 9, rust is generated, and the corrosion resistance is inferior. It is thought from this result that the amount of addition of carbon is related to the corrosion resistance. In Experimental Examples 11 to 13, the corrosion resistance is satisfactory, and therefore, the amount of addition of carbon is more suitably not more than 0.25% by weight. It is estimated that when the amount of addition of carbon is high, the carbon steel tube is too hard so that the surface processability in the sand blast treatment is inferior, whereby a scratch is generated, and the subject part is not sufficiently covered. Thus, rust is generated. Then, in the image evaluation, it is estimated that a toner is fixed in the rust-generated part, thereby generating black spot.

3) In Experimental Example 14, nevertheless the amount of addition of carbon is not more than 0.25% by weight, the scatter of the surface roughness is large, and the surface processability in the sand blast treatment is inferior. It is thought from this result that the amounts of addition of silicon and manganese are related to the processability in the sand blast treatment. In Experimental Examples 11 to 13, the scatter of the surface roughness is small, and therefore, the amount of addition of silicon is more suitably not more than 0.30% by weight, and the amount of addition of manganese is more suitably not more than 0.85% by weight. Then, in the image evaluation, it is estimated that the scatter of the surface roughness became a cause of unevenness in density.

4) It is thought that the addition of slight amounts of phosphorus and sulfur enhances the processability.

As the manufacture method of a tube, any of a seamless tube or a seamed tube (welded tube) can be used. However, the seamed tube is high in costs because the nonuniformity in wall thickness is large and cutting processing for centering is necessary so that a tube stock having a thick wall is necessary and a number of processing steps for revealing shape accuracy (straightness and coaxiality) are necessary. In order to manufacture a developing roller with high-dimensional accuracy, an electro-resistance-welded tube (welded tube) prepared by rounding a steel sheet having a uniform thickness and joining both end parts by high-frequency welding or the like is effective. In such an electro-resistance-welded tube, not only material costs as a tube stock can be reduced because the nonuniformity in wall thickness is small and the shape accuracy is high, but also processing costs for revealing the dimensional accuracy as a developing roller can be reduced because the shape accuracy is easily revealed even in a thin-walled tube. In addition, by manufacturing an electro-resistance-welded tube using a carbon steel tube having the foregoing proper chemical components, it is possible to realize a developing roller having a higher dimensional accuracy with less influences of return of a processing strain (residual stress).

In order to meet the foregoing dimensional accuracy, it is preferable that the cylindrical metal base body is a carbon steel tube as cut or polished so as to have a thickness of from 0.75 to 2.0 mm and a straightness of not more than 15 μm.

The wall thickness as a carbon steel tube of a cylindrical metal base body is in the range of from 0.75 to 2 mm, and in applying as a developing roller, when the wall thickness is thinner than 0.75 mm, the mechanical rigidity is lowered so that dimensional accuracy is not obtained. On the other hand, when the wall thickness is thicker than 2 mm, though the mechanical rigidity is met, the upper limit of the wall thickness was defined to be 2 mm from the viewpoints of weight, material costs, and the like. In addition, in order to meet the dimensional accuracy, the straightness is required to be not more than 15 μm.

The invention claimed is:

1. An electrophotographic developing roller having a cylindrical metal base body and a metal flange press fitted in an opening end section of said cylindrical metal base body, wherein said metal flange has a larger diameter section for fitting in an opening end section inner surface of said cylindrical metal base body and a smaller diameter section serving as a central shaft body coaxial with said cylindrical metal base body; and wherein a fit section surface of said larger diameter section before being press fitted has an uneven shape such that a maximum roughness Ry due to a circumferential groove formed by cutting processing is from 25 μm to 70 μm.

2. The electrophotographic developing roller according to claim 1, wherein an adhesive is used in said fit section.

3. The electrophotographic developing roller according to claim 2, wherein said adhesive is an anaerobic adhesive.

4. The electrophotographic developing roller according to claim 1, wherein a countersunk section is provided on the opening end section inner surface of said cylindrical metal base body.

5. The electrophotographic developing roller according to claim 1, wherein a thickness of said cylindrical metal base body is from 0.75 mm to 2 mm; and an interference at a time of press fitting is from 10 μm to 60 μm.

6. The electrophotographic developing roller according to claim 1, wherein said cylindrical metal base body and said metal flange are each made of steel or an aluminum based alloy as a principal material.

7. The electrophotographic developing roller according to claim 1, wherein said cylindrical metal base body is made of a carbon steel tube containing not more than 0.25% by weight of carbon, not more than 0.30% by weight of silicon, and not more than 0.85% by weight of manganese.

8. The electrophotographic developing roller according to claim 1, wherein said cylindrical metal base body is made of an STKM11A carbon steel tube (JIS G3445).

9. The electrophotographic developing roller according to claim 1, wherein said cylindrical metal base body is an electro-resistance-welded tube.

10. The electrophotographic developing roller according to claim 1, wherein said cylindrical metal base body is subjected to cutting processing or polishing processing.

11. The electrophotographic developing roller according to claim 1, wherein an outer surface of said cylindrical metal base body is subjected to a blast treatment.

12. The electrophotographic developing roller according to claim 11, wherein the outer surface of said cylindrical metal base body having been subjected to a blast treatment is further subjected to metal plating.

13. The electrophotographic developing roller according to claim 1, wherein an outer surface of said cylindrical metal base body is subjected to metal plating.

14. The electrophotographic developing roller according to claim 13, wherein said metal plating is electroless nickel plating.

15. The electrophotographic developing roller according to claim 13, wherein the outer surface of said cylindrical metal base body having been subjected to metal plating is further subjected to a chromate treatment.

16. The electrophotographic developing roller according to claim 13, wherein said metal plating is achieved without performing a zinc alloy film formation treatment in advance.

17. The electrophotographic developing roller according to claim 1, wherein said cylindrical metal base body has a straightness of not more than 15 μm.

18. The electrophotographic developing roller according to claim 1, wherein said cylindrical metal base body has a deflection accuracy of not more than 20 μm.

19. The electrophotographic developing roller according to claim 1, wherein said electrophotographic developing roller is used in an electrophotographic device of a non-magnetic one-component non-contact development system.

20. The electrophotographic developing roller according to claim 1, wherein said electrophotographic developing roller is used in a color electrophotographic device.

21. An image forming device, wherein the image forming device is mounted with the electrophotographic developing roller according to claim 1.

22. An electrophotographic developing roller having a cylindrical metal base body and a metal flange press fitted in an opening end section of said cylindrical metal base body, wherein said metal flange has a larger diameter section for fitting in an opening end section inner surface of said cylindrical metal base body and a smaller diameter section serving as a central shaft body coaxial with said cylindrical metal base body; and wherein a fit section surface of the opening end section inner surface of said cylindrical metal base body before being press fitted has an uneven shape such that a maximum roughness Ry due to a circumferential groove formed by cutting processing is from 25 μm to 70 μm.

23. An electrophotographic developing roller having at least a cylindrical metal base body, for coming into contact with or becoming adjacent to a photoreceptor, thereby feeding a developer on a surface of said photoreceptor and developing an electrostatic latent image formed on said photoreceptor, wherein said cylindrical metal base body is made of a carbon steel tube containing not more than 0.25% by weight of carbon, not more than 0.30% by weight of silicon, and not more than 0.85% by weight of manganese, respectively.

24. An electrophotographic developing roller having at least a cylindrical metal base body, for coming into contact with or becoming adjacent to a photoreceptor, thereby feeding a developer on a surface of said photoreceptor and developing an electrostatic latent image formed on said photoreceptor, wherein said cylindrical metal base body is made of an STKM11A carbon steel tube (JIS G3445).

* * * * *

UNITED STATES PATENT AND TRADEMARK OFFICE

CERTIFICATE OF CORRECTION

PATENT NO. : 7,450,892 B2
APPLICATION NO. : 10/567062
DATED : November 11, 2008
INVENTOR(S) : Toshio Tsubota et al.

It is certified that error appears in the above-identified patent and that said Letters Patent is hereby corrected as shown below:

On the Title Page, Item (73)

Please change the assignee's name and address on the first page, "Fuji Electric Imaging Device Co., Ltd., Nagano-ken (JP)" to --Fuji Electric Device Technology Co., Ltd., Tokyo (JP)--.

Please change column 1, line 58, "which is anon-" to --which is a non- --;

Column 1, line 66, "from 1 to 3%" to --from 0.1 to 3%--;

Column 2, line 9, "to provide a uniform a" to --to provide a uniform a- --;

Column 17, line 20, "As a counter" to --As a counter- --;

Column 22, line 28, "and a metal flange press" to --and a metal flange as press--; and Column 24, line 5, "and a metal flange press" to --and a metal flange as press--.

Signed and Sealed this

Twenty-seventh Day of January, 2009

JOHN DOLL
*Acting Director of the United States Patent and Trademark Office*